United States Patent [19]

Benn et al.

[11] Patent Number: 5,006,163

[45] Date of Patent: Apr. 9, 1991

[54] TURBINE BLADE SUPERALLOY II

[75] Inventors: Raymond C. Benn, Huntington, W. Va.; Jeffrey M. Davidson, Summit, N.J.; Kenneth R. Andryszak, Goshen, N.Y.

[73] Assignee: Inco Alloys International, Inc., Huntington, W. Va.

[21] Appl. No.: 348,383

[22] Filed: May 8, 1989

Related U.S. Application Data

[63] Continuation of Ser. No. 711,199, Mar. 13, 1985.

[51] Int. Cl.[5] ..... B22F 1/00

[52] U.S. Cl. ..... 75/229; 75/233; 75/234; 75/235; 148/410; 148/428; 420/445; 420/446; 420/447; 420/448

[58] Field of Search ..... 420/446, 445, 447, 448; 148/410, 428; 75/235, 229, 234, 233

[56] References Cited

U.S. PATENT DOCUMENTS

| | | | |
|---|---|---|---|
| 4,292,076 | 9/1981 | Gigliotti et al. | 75/170 |
| 4,386,976 | 6/1983 | Benn et al. | 148/410 |
| 4,668,312 | 5/1987 | Benn et al. | 148/428 |

FOREIGN PATENT DOCUMENTS

| | | | |
|---|---|---|---|
| 2353971 | 7/1973 | Fed. Rep. of Germany | 420/448 |

*Primary Examiner*—Stephen J. Lechert, Jr.
*Attorney, Agent, or Firm*—Francis J. Mulligan, Jr.; Edward A. Steen

[57] ABSTRACT

A novel, nickel-base, high temperature alloy body preferably containing about 20% chromium, 6 to 7% aluminum to provide phase, 1.5 to 2.5% molybdenum, 3 to 4.5% tungsten, additional strengthening elements and oxidic yttrium in finely dispersed form. The alloy body has an elongated crystal structure and is characterized by high strength along with excellent hot corrosion and oxidation resistance.

2 Claims, 1 Drawing Sheet

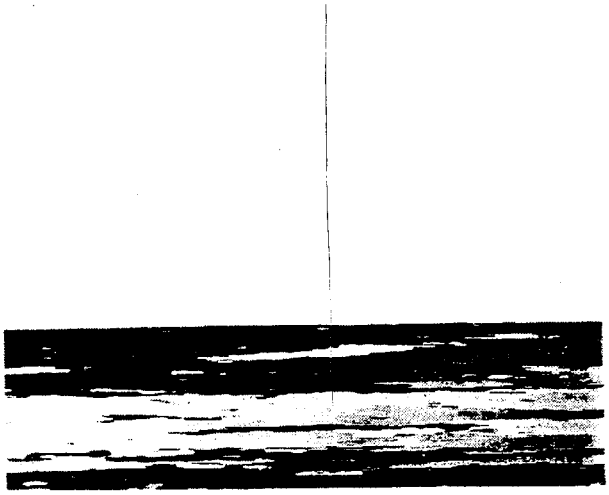

TURBINE BLADE SUPERALLOY II

This is a continuation of co-pending application Ser. No. 06/711,199, filed on Mar. 13, 1985.

The present invention is directed to metallic alloy bodies especially suitable for use as structures in hot sections of an industrial gas turbine (IGT) and more particularly to nickel-base alloy bodies suitable for such usage.

BACKGROUND AND PROBLEM

A modern, advanced design industrial gas turbine (IGT) has hot stage blades and vanes which are required to perform for lives of 2 to $5\times10^4$ up to $10^5$ hours, e.g. at least about 30,000 hours in a corroding environment resulting from the combustion of relatively low grade fuels and, in the case of blades, under high stress. Naturally, in order to increase efficiency, it is desired to operate such IGT blades and vanes at the higher practical operating temperatures consistent with achieving the design life-times. When considering operating temperatures, it is necessary to take into account not only the highest temperature to which a turbine blade is exposed, but also a range of temperatures below that highest temperature. Even at steady-state operation, a turbine blade will experience a variety of temperatures along its length from root to tip and across its width from leading to trailing edge.

Over the long design lives of IGT blades and vanes, corrosion resistance and oxidation resistance become more important factors than they are in the well-developed field of aircraft gas turbine (AGT) alloys. Although in neither the case of AGT nor IGT turbine blades or vanes would it be advisable to select an oxidation or corrosion prone alloy, the longer (by an order of magnitude) time exposure of IGT components to a more corroding atmosphere make oxidation and corrosion resistance very important features of IGT alloy structures. IGT alloy structures such as hot stage blades and vanes can be coated with conventional coatings to enhance oxidation and corrosion resistance but these coatings are subject to cracking, spalling and the like. Over the long design lives of IGT components, it is more likely that coating failures will occur in comparison to such failures with AGT coated components used for shorter time periods. Thus, even if coated, an IGT alloy structure used in the hot stage of an IGT must have the best oxidation and corrosion resistance obtainable commensurate with other required properties and characteristics.

In designing alloy structures for IGT turbine blades it is natural to investigate nickel-base alloys which are used conventionally in AGT turbine blades. Even the strongest conventional, $\gamma'$ strengthened nickel base alloys rapidly lose strength at temperatures above about 900° C. (see FIG. 2 of U.S. Pat. No. 4,386,976). It is disclosed in U.S. Pat. No. 4,386,976 however that nickel-base alloys combining $\gamma'$ strengthening and strengthening by a uniform dispersion of microfine refractory oxidic particles can provide adequate mechanical properties in the temperature range of 750° C. up to 1100°. However, the alloys disclosed in U.S. Pat. No. 4,386,976 are deemed to have inadequate oxidation and corrosion resistance for use in advanced design IGTs. It is also known, for example, from U.S. Pat. No. 4,039,330 that $\gamma'$ strengthened nickel-base alloys containing in the vicinity of 21 to 24 weight percent chromium along with some aluminum have excellent corrosion and oxidation resistance, of the character needed for IGT usage. At very high temperatures, e.g. over 1000° C., the oxidation resistance of alloys as disclosed in U.S. Pat. No. 4,039,330 tends to fall off. Strength at temperatures in excess of 900° C. of the alloys disclosed in U.S. Pat. No. 4,039,330, as with all $\gamma'$ strengthened nickel-base alloys is inadequate for components of advanced design IGTs.

From the background in the immediately preceding paragraph one might be tempted to declare that the solution to providing turbine blades for advanced design IGTs is obvious. Either increase the chromium and/or aluminum content of $\gamma'$ and dispersion strengthened alloys disclosed in U.S. Pat. No. 4,386,976 or add dispersion strengthening to the alloys disclosed in U.S. Pat. No. 4,039,330. These appealing, seemingly logical solutions to the existing problem are overly simplistic.

The first possibility i.e., increasing the chromium and/or the aluminum content of a known $\gamma'$ and dispersion strengthened alloy, has two difficulties. Increasing either chromium or aluminum can tend to make a nickel-base alloy sigma prone. Increase of chromium directly dilutes the nickel content of the alloy matrix remaining after $\gamma'$ phase precipitation. Increasing the aluminum content increases the amount of $\gamma'$ phase ($Ni_3Al$-Ti) which can form in the nickel-base alloy again diluting the matrix with respect to nickel. Detrimental acicular sigma phase tends to form in nickel-base alloys having low nickel matrix contents after intermediate temperature (e.g., 800° C.) exposure resulting in low alloy ductility. Because the existence of $\gamma'$ phase is essential to component strength at temperatures up to about 900° C., it is necessary to carefully control alloy modification to avoid phase instability over the long term usage characteristic of IGTs where a minimum acceptable ductility is essential. From another point of view, indiscriminate alloy modification especially in the realm of increasing aluminum and/or chromium contents presents a difficulty in providing the component microstructure essential to strength of dispersion strengthened alloys at high temperature. Referring again to U.S. Pat. No. 4,386,976 Column 1, line 58 et seq., it is disclosed that ODS (oxide dispersion strengthened) alloys must be capable of developing a coarse, elongated grain structure in order to obtain good elevated temperature properties therein. This coarse, elongated grain structure is developed by directional, secondary recrystallization at a temperature above the $\gamma'$ solvus temperature and below the incipient melting temperature of the alloy (see Column 6, line 58 et seq. of the U.S. Pat. No. 4,386,976) or some temperature close to the incipient melting temperature. If $\gamma'$ phase is not solutioned, the secondary crystallization will not proceed. If the incipient melting temperature of the alloy is exceeded the oxide dispersion will be detrimentally affected. For practical production, the interval between the $\gamma'$ solvus temperature and the temperature of incipient melting must be at least about 10° and, more advantageously, at least about 20° in celsius units. Because of the complexity of modern $\gamma'$ strengthened alloy compositions and the complex interactions among the alloying elements, there is no way of predicting the secondary recrystallization interval which is a sine qua non for obtaining the high temperature strength in ODS alloys.

The same difficulty applies to the possible idea of providing oxide dispersion strengthening to a known, high strength $\gamma'$ oxidation and corrosion-resistant alloy.

There is no way of predicting whether nor not the theoretical ODS-$\gamma'$ strengthened alloy can be made on a commercial basis.

The foregoing makes it clear that the provision of alloy components suitable for hot stage advanced design IGT usage is a problem that requires critical metallurgical balancing to at least provide an adequate window for thermal treatment necessary for practical production of such components. In addition, the alloy composition must be capable of undergoing the practical mechanical and thermomechanical processing required to reach the stage of directional recrystallization.

The present invention provides alloy bodies suitable for use in advance design IGTs which can be produced in a practical manner.

BRIEF DESCRIPTION OF THE DRAWING

The FIGURE is a photograph showing the grain structure of an alloy body of the invention.

SUMMARY OF THE INVENTION

The present invention comtemplates an alloy body especially useful as a component in hot stages of industrial gas turbines having improved resistance to long term stress at temperatures in the range 800° to 1100° C. combined with enhanced oxidation and corrosion resistance. The alloy body comprises at least in part, an aggregation of elongated, essentially parallel metallic crystals having grain boundaries therebetween wherein the average grain aspect ratio of said metallic crystals is at least about 7. These metallic crystals (1) have a $\gamma'$ phase dispersed therein at a temperature lower than about 1180° C. and (2) have dispersed therethrough particles in the size range of about 5 to 500 nanometers in major dimension of an oxidic phase stable at temperatures below at least 1100° C. The metallic crystal inclusive of dispersed material and grain boundary material consists essentially in weight percent of about 18 to 25% chromium, about 5.5 to 9% aluminum, up to, i.e. 0 to about 1% titanium with the proviso that the sum of the percentages of aluminum and titanium is no greater than 9, up to about 4.5% molybdenum, about 3 to 8% tungsten, up to about 0.05%, e.g. about 0.005 to 0.05% boron, up to about 0.5% zirconium, about 0.4 to 1% yttrium, about 0.4 to about 1% oxygen, up to about 0.2% carbon, up to about 1% or 2% iron, up to about 0.3 or 0.5% nitrogen, up to about 4% tantalum, up to about 2% niobium (with the proviso that tantalum, if any, and niobium, if any, are present in the alloy only when the aluminum content is below about 7%), up to about 10% cobalt, up to about 2% hafnium, up to about 4% rhenium (in replacement of all or part of molybdenum and/or tungsten) the balance except for impurities and incidental elements being nickel. In these alloy bodies, substantially all of the yttrium and a part of the aluminum exist as oxides forming the principal part of the dispersed stable oxidic phase. Depending upon the exact conditions of manufacture and use, the dispersed oxidic phase can comprise yttria and alumina or alumina-yttria mixed oxides such as $Al_2O_3.2Y_2O_3$, $Al_2O_3.Y_2O_3$ or $5Al_2O_3.3Y_2O_3$ and comprises about 2.5 to about 4 volume percent of the metallic crystals.

Generally speaking, the alloy body of the present invention is produced by mechanically alloying powdered elemental or master alloy constituents along with oxidic yttrium in an attritor or a horizontal ball mill until substantial saturation hardness is obtained along with thorough interworking of the attrited metals one within another and effective inclusion of the oxide containing yttrium within attrited alloy particles to provide homogeneity. For best results, the milling charge should include powder of an omnibus master alloy, i.e. an alloy containing all non-oxide alloying ingredients in proper proportion except being poor in nickel or nickel and cobalt. This omnibus master alloy powder is produced by melting and atomization, e.g. gas atomization. The mill charge consists of the omnibus master alloy, yttria or oxidic yttrium and appropriate amounts of nickel, nickel and cobalt or nickel-cobalt alloy powder.

The milled powder is then screened, blended and packed into mild steel extrusion cans which are sealed and may be evacuated. The sealed cans are then heated to about 1000° C. to 1200° C. and hot extruded at an extrusion ratio of at least about 5 using a relatively high strain rate. After extrusion or equivalent hot compaction, the thus processed mechanically alloyed material can be hot worked, especially directionally hot worked by rolling or the like. This hot working should be carried out rapidly in order to preserve in the metal a significant fraction of the strain energy induced by the initial extrusion or other hot compaction. Once this is done, the alloy body of the invention is processed by any suitable means, e.g., zone annealing, to provide coarse elongated grains in the body having an average grain aspect ratio (GAR) of at least 7. If required, the thus produced alloy body can be given a solution treatment and a subsequent aging heat treatment to precipitate $\gamma'$ phase in addition to that amount of $\gamma'$ phase forming on cooling from grain coarsening temperatures. It has been found that for alloys having a composition within the range as disclosed hereinbefore, the overall grain coarsening interval, i.e., $T_{ic}$ (Temperature of incipient melting) $-T_{\gamma's}$ ($\gamma'$ solvus temperature) is at least about 20° in Celsius units thereby providing an adequate processing window for commercial production of alloy bodies having coarse elongated grains of high GAR. For alloy bodies of the present invention, solution treatment can be for 1 to 20 hours at 1050° to 1300° C. Satisfactory aging treatments involve holding the alloy body at a temperature in the range of 600° to 950° C. for 1 to 24 hours. An intermediate aging comprising holding the alloy body for 1 to 16 hours in the range of 800° to 1150° C. interposed between the solution treatment and the final aging treatment can be advantageous.

DESCRIPTION OF THE PREFERRED EMBODIMENT

Alloy bodies of the present invention advantageously contain, in combination or singly, the following preferred amounts of alloying ingredients:

| Ingredient | % by Wt. | Ingredient | % by Wt. |
|---|---|---|---|
| Cr | 19–21 | Co | 0 |
| Al | 6–7 | Hf | 0 |
| Ti | 0 | C | 0–0.1 |
| Ta | 0 | Re | 0 |
| Nb | 0 | Zr | 0.05–0.25 |
| Mo | 1.5–2.5 | | |
| W | 3–4.5 | | |

The compositions, in weight percent, of ingredients analyzed (assuming all yttrium to be present as yttria), of specific examples of alloys making up alloy bodies of the present invention are set forth in Table I.

TABLE I

| Alloy | Ni | Cr | Al | Mo | W | C | B | Zr | $Y_2O_3$ | Fe | O | N |
|---|---|---|---|---|---|---|---|---|---|---|---|---|
| 1 | Bal | 19.5 | 6.7 | 2.0 | 3.8 | 0.044 | 0.011 | 0.15 | 0.57 | 0.78 | 0.48 | 0.16 |
| 2 | Bal | 19.6 | 6.6 | 1.9 | 3.5 | 0.042 | 0.011 | 0.15 | 0.55 | 0.80 | 0.46 | 0.15 |
| 3 | Bal | 20.2 | 6.7 | 2.0 | 3.5 | 0.043 | 0.011 | 0.16 | 0.99 | 0.64 | 0.52 | 0.18 |

Each of the alloy compositions was prepared by mechanical alloying of batches in an attritor using as raw material nickel powder Type 123, elemental chromium, tungsten, molybdenum, tantalum and niobium, nickel 47.5% Al master alloy, nickel-28% zirconium master alloy, nickel-16.9% boron master alloy and yttria. In each case the powder was processed to homogeneity. Each powder batch was screened to remove particles exceeding 12 mesh, cone blended two hours and packed into mild steel extrusion cans which were evacuated and sealed. Up to four extrusion cans were prepared for each composition. The cans were heated in the range (1000° C. to 1200° C.) and extruded into bar at an extrusion ratio of about 7. Extrusion was performed on 750 ton press at about 35% throttle setting. The extruded bar material was subjected to hot rolling at temperatures from about 1200° C. to about 1300° C. and at total reductions up to about 60% (pass reductions of about 20%) with no difficulties being encountered.

Heat treating experiments determined that the extruded bar material would grow a coarse elongated grain and that zone annealing at an elevated temperature, in the range of about 1200° C. to about 1315° C. was an effective grain coarsening procedure.

Tensile tests, stress-rupture tests, oxidation tests and sulfidation tests were conducted on alloy bodies having a coarse grain structure of high GAR in accordance with the invention with the results shown in the following Tables. The tensile and stress-rupture tests were all conducted in the longitudinal direction as determined by the grain structure of the alloy body. Prior to testing, the alloys as set forth in Table I were formed into alloy bodies of the invention by the zone annealing treatment set forth in Table II. Particular heat treatments employed are also set forth in Table II.

TABLE II

| Alloy | Zone Anneal Temp (°C.) | Zone Anneal Speed mm/hr | Heat Treatment hours - °C. - AC (air cooling) |
|---|---|---|---|
| 1 | 1260 | 76 | 2-1279-AC + 2 – 954-AC + 24 – 843-AC |
| 2 | 1260 | 76 | 2-1279-AC + 2 – 954-AC + 24 – 843-AC |
| 3 | 1260 | 76 | 2-1279-AC + 2 – 954-AC + 24 – 843-AC |

Some of the alloy bodies of the invention as zone annealed and heat treated as set forth in Table II were tensile tested at various temperatures as reported in Table III.

TABLE III

| Alloy Body | Y.S. (MPa) 0.2% Offset | U.T.S. (MPa) | El (%) | R.A. (%) |
|---|---|---|---|---|
| | ROOM TEMPERATURE | | | |
| 1 | 1113 | 1320 | 3.0 | 2.5 |
| 2 | 1123 | 1208 | 1.0 | 5.0 |
| | 600° C. | | | |
| 1 | 1013 | 1237 | 5.0 | 4.0 |
| 2 | 1005 | 1241 | 5.0 | 8.5 |
| | 800° C. | | | |
| 1 | 758 | 876 | 5.0 | 8.5 |
| 2 | 743 | 916 | 1.0 | 1.0 |
| | 1000° C. | | | |
| 1 | 224 | 266 | 8.0 | 16.0 |
| 2 | 207 | 266 | 7.0 | 13.5 |

TABLE III-continued

| Alloy Body | Y.S. (MPa) 0.2% Offset | U.T.S. (MPa) | El (%) | R.A. (%) |
|---|---|---|---|---|
| | 1100° C. | | | |
| 1 | 109 | 117 | 17.0 | 40.0 |
| 2 | 116 | 119 | 14.0 | 37.0 |

Samples of Alloy body 1 tested under stress for creep-rupture exhibited the characteristics as reported in Table IV.

| Temperature (°C.) | Stress (MPa) | Life (h) | EL (%) | RA (%) | Minimum Creep Rate (%/h) |
|---|---|---|---|---|---|
| 816 | 600 | 1.1 | 3.0 | 6.0 | |
| 816 | 450 | 16.5 | 4.0 | 4.7 | |
| 816 | 400 | 111.9 | 2.5 | 4.0 | |
| 816 | 350 | 374.3 | 1.6 | 6.7 | 0.002 |
| 816 | 325 | 714.5 | 1.5 | 3.5 | |
| 816 | 300 | 1750.6 | 2.5 | 2.5 | 0.00027 |
| 816 | 270 | 4301.8 | 1.5 | 2.0 | 0.00015 |
| 982 | 193 | 2.1 | 11.2 | 28.5 | |
| 982 | 172 | 5.7 | 9.5 | 24.5 | |
| 982 | 160 | 49.7 | 3.2 | 9.3 | 0.0088 |
| 982 | 150 | 66.7 | 2.5 | 1.0 | 0.0065 |
| 982 | 135 | 2533.3 | 1.0 | 2.0 | 0.00006 |

Other tests have established the rupture stress capabilities of alloy bodies 2 and 3 as set forth in Table V.

TABLE V

| Alloy Body No. | Rupture Stress Capabilities (MPa) 816° C. $10^2$h | 816° C. $10^3$h | 816° C. $10^4$h | 982° C. $10^2$h | 982° C. $10^3$h | 982° C. $10^4$h |
|---|---|---|---|---|---|---|
| 1 | 400 | 320 | 260 | 160 | 150 | 135 |
| 2 | 375 | 290 | 240* | 160 | NA | NA |
| 3 | 410 | 325 | 260* | 160 | 150 | 135* |

*Extrapolated Value
NA - Not Available Yet

Alloy body No. 1 was tested for hot corrosion under test conditions (1) at 926° C. and 843° C.—JP-5 fuel+0.3 Wt. % S, 5 ppm sea salt, 30:1 air-to-fuel ratio, 1 cycle/hour (58 min. in flame, 2 min. out in air) 500 h test duration and (2) at 704° C.—Diesel #2 fuel+3.0 Wt. % S, 10 ppm sea salt, 30:1 air-to-fuel ratio, 1 cycle/day (1425 minutes in flame, 15 minutes out in air) 500 hour test duration. At 926° C. metal loss was 0.0051 mm with a maximum attack of 0.086 mm. At 843° C. metal metal loss and maximum attack were both 0.0051 mm. At 704° C. metal loss and maximum attack were both 0.084 mm.

In addition to the hot corrosion tests specified in the foregoing paragraph alloy bodies of the invention were subjected to cyclic oxidation tests in which alloy body specimens were held at the temperatures specified in Table VI in air containing 5% water for 24 hour cycles and then cooled in air for the remainder of the cycle. Table VI reports results in terms of descaled weight change (mg/cm$^2$) of these tests.

TABLE VI

| Alloy Body | Descaled Wt. Change (mg/cm$^2$) 1000° C./41 Cycles | 1100° C./21 Cycles |
|---|---|---|
| 1 | −0.475 | −0.928 |
| 2 | −0.800 | −0.992 |
| 3 | −0.787 | −0.916 |

In order to assess the stability of alloy bodies of the invention, they were exposed, unstressed, to an air atmosphere at 816° C. for various times and then examined, either microscopically or by means of a room temperature tensile test. Microscopic examination of alloy bodies 1 and 3 showed no evidence of formation of sigma phase after 6272 hours of exposure. Room temperature tensile test results of alloy bodies of the present invention after specified times of unstressed exposure at 816° C. in an air atmosphere are set forth in Table VII.

TABLE VII

| Alloy Body No. c) | Exposure at 816° C. (Hours) | YS (MPa) .2% Offset | UTS (MPa) | El. % | RA. % | Hardness (R |
|---|---|---|---|---|---|---|
| 1 | 6000 | 923 | 1096 | 4.3 | 4.6 | 41–42 |
| 1 | 8000 | 893 | 1061 | 5.1 | 4.3 | 43 |
| 2 | 6000 | 885 | 1032 | 3.0 | 6.2 | 41 |
| 2 | 8000 | 872 | 1050 | 1.3 | 3.5 | 40–41 |
| 3 | 6000 | 913 | 1051 | 1.6 | 3.3 | 40–43 |

Tables III through VII together in comparison to data in U.S. Pat. Nos. 4,386,976 and 4,039,330 mentioned hereinbefore show that alloy bodies of the present invention are suitable for use as IGT hot stage blades and other components. For example, Tables III to V show that in strength characteristics, the alloy bodies of the present invention parallel the strength characteristics of INCONEL TM MA6000 (U.S. Pat. No. 3,926,568) whereas Tables VI and VII show that in corrosion and oxidation resistance, the alloy bodies of the present invention exhibit characteristics akin to or better than IN-939 (U.S. Pat. No. 4,039,330). The drawing depicts the coarse elongated grain structure of the alloy bodies of the invention which is instrumental in providing their advantageous strength characteristics. Referring now thereto, the optical photograph of the Figure shows the etched outline of course metallic grains bound together by grain boundary material.

Those skilled in the art will appreciate that alloy bodies of the present invention can include volumes in which the grain structure can deviate from the coarse elongated structure depicted in the drawing provided that such volumes are not required to possess extreme mechanical characteristics at very high temperatures. For example, in a turbine blade structure, part or all of the root portion can have a grain structure differing from the coarse, elongated, longitudinally oriented grain structure of the blade portion.

In view of the total aluminum and chromium contents of the alloy bodies of the invention, it is expected that these alloy bodies will constitute compatible substrates for both diffused aluminide coatings and for various high aluminum, high chromium deposited coatings, e.g. M-Cr-Al-Y coatings where M is a metallic element such as nickel or cobalt. By use of such coatings the already high corrosion and oxidation resistance of alloy bodies of the invention can be further enhanced.

While the present invention has been described with respect to specific embodiments, those skilled in the art will appreciate that alterations and modifications within the spirit of the invention can be made. Such alterations and modifications are intended to be within the ambit of the appended claims.

We claim:

1. A zone-annealed recrystallized alloy body especially useful in hot stages of industrial gas turbines having improved resistance to long term stress at temperatures in the range 800° to 1100° C. combined with enhanced oxidation and corrosion resistance comprising, in at least part, an aggregation of elongated, essentially parallel metallic crystals having grain boundaries therebetween wherein the average grain aspect ratio of said metallic crystals is at least about 7, said metallic crystals (1) having a $\gamma'$ phase dispersed therein at a temperature lower than about 1180° C. and (2) having dispersed therethrough particles in the range of about 5 to 500 nanometers in major dimension of a stable yttrium-containing oxidic phase, said metallic crystals and grain boundary material consisting essentially in weight percent of about 19 to about 21% chromium, about 6 to about 7% aluminum, up to about 1% titanium, up to about 4% tantalum, up to about 2% niobium about 1.5 to 2.5% molybdenum, about 3 to about 4.5% tungsten, up to about 10% cobalt, up to about 2% hafnium, about 0.4 to about 1% oxygen, about 0.4 to about 1% yttrium, up to about 0.2% carbon, up to about 0.05% boron, up to about 0.5% zirconium, up to about 2% iron, up to about 0.5% nitrogen, up to about 4% rhenium in replacement of an equal percentage of molybdenum or tungsten, the balance, except for impurities being essentially nickel.

2. An alloy body as in claim 1 which contains essentially no titanium, tantalum, niobium, cobalt, hafnium and rhenium.

* * * * *